US005390765A

United States Patent [19]

Ujihara et al.

[11] Patent Number: 5,390,765

[45] Date of Patent: Feb. 21, 1995

[54] METHOD OF OPERATING ELEVATOR

[75] Inventors: Hideyo Ujihara; Izumi Nanya, both of Inazawa, Japan

[73] Assignee: Mitsubishi Denki Kabushiki Kaisha, Tokyo, Japan

[21] Appl. No.: 160,330

[22] Filed: Dec. 2, 1993

Related U.S. Application Data

[63] Continuation-in-part of Ser. No. 68,313, May 27, 1993, abandoned, which is a continuation of Ser. No. 754,310, Sep. 4, 1991, abandoned, which is a continuation of Ser. No. 497,640, Mar. 3, 1990, abandoned.

[30] Foreign Application Priority Data

Apr. 27, 1989 [JP] Japan ..... 1-108078

[51] Int. Cl.[6] ..... B66B 1/34

[52] U.S. Cl. ..... 187/380; 187/38

[58] Field of Search ..... 187/121, 122, 126, 127

[56] References Cited

U.S. PATENT DOCUMENTS

| | | | |
|---|---|---|---|
| 2,222,193 | 11/1940 | Crabbe et al. | 187/126 |
| 3,584,707 | 6/1971 | Suozzo et al. | 187/128 |
| 4,026,389 | 5/1977 | Magee | 187/126 |
| 4,662,478 | 5/1987 | Uchino | 187/114 |

FOREIGN PATENT DOCUMENTS 59-182177 10/1984 Japan .

*Primary Examiner*—Steven L. Stephan
*Assistant Examiner*—Robert Nappi
*Attorney, Agent, or Firm*—Leydig, Voit & Mayer

[57] ABSTRACT

In a program of running direction determination steps wherein the presence of a call signal, which is based on activation of floor call buttons provided in a cage of an elevator of hall buttons disposed at halls of respective floors, is repeatedly monitored so as to determine the running direction of the cage of the elevator. This program includes the cage running direction determination step of reversing the running direction of the cage with preference over any other call signal when a floor call in the rear of the cage has been registered anew while the cage is at rest at any of the halls.

2 Claims, 4 Drawing Sheets

: STAND BY WITH DOOR CL
NON DIR

: CL DOOR
START UP-WARD RUN

: STAND BY WITH DOOR CL
DOWN RUNNING DIR

METHOD OF OPERATING ELEVATOR

This application is a continuation-in-part of application Ser. No. 08/068,313, filed on May 27, 1993, which is a continuation of prior application Ser. No. 07/754,310, filed on Sept. 4, 1991, which is a continuation of prior application Ser. No. 07/497,640, filed on Mar. 3, 1990, all abandoned.

BACKGROUND OF THE INVENTION

This invention relates to a method of operating a home elevator which is installed in a private house or the like.

In recent years, two-household habitation has increased along with the upper age bracket, and housing sites have become smaller areas due to this situation, resulting in taller private houses. In this regard, elevators for private houses suitable for a 3- or 4-storeyed building and a capacity of 3 or so have been increasingly in demand in order to relieve the burden and trouble in ascending and descending stairs, and an appropriate operating method for the elevators has been requested.

FIG. 3 is a diagram of the conventional system of an elevator in which an operating method in the prior art and an operating method in an embodiment of this invention are performed, while FIG. 4 is a diagram of the internal arrangement of a control panel 1 in FIG. 3. Referring to FIG. 3, the conventional elevator system includes the control panel 1, a motor 2, a hoist 3, a counterweight 4, a cage 5, a cage operation panel 6 which is furnished with floor call buttons, and hall buttons 7–10 which have no direction, one hall button being arranged at the hall of each floor. Referring to FIG. 4, the control panel 1 includes a central processing unit (hereinbelow, abbreviated to "CPU") 11, a group of signal lines 12 having an address bus, a data bus, a control bus, etc., a read-only memory (hereinbelow, abbreviated to "ROM") 13 in which an elevator operation program containing steps for determining the running direction of the cage 5 are kept stored, a random access memory (hereinbelow, abbreviated to "RAM") 14 which temporarily stores calculated results etc., and an input/output interface unit 15 which executes the signal conversions (such as voltage level conversion, analog/digital conversion, and serial/parallel conversion) between the CPU 11 and the elevator devices such as the cage operation panel 6, the hall buttons 7–10 at the respective floor halls, and the motor 2.

The operation of the elevator constructed as described above is outlined as follows: When a user in the cage 5 depresses any floor call button of the cage operation panel 6, or when a user to get on the cage 5 depresses any of the nondirectional hall buttons 7–10 at the halls of the respective floors, the CPU 11 of the control panel 1 senses the floor call button signal or hall button signal of the depressed button and accepts it into the RAM 14 through the input/output interface unit 15 so as to register a floor call signal or a hall call signal. The floor call signal or hall call signal registered in the RAM 14 is not cancelled before it is responded to by the cage 5. The CPU 11 continually and repeatedly executes the program of the running direction determination steps, which is the subroutine of the operation program stored in the ROM 13, to monitor the presence of any call signal. In the presence of the call signal, the CPU 11 processes this signal and sets the running direction of the cage 5 of the elevator in accordance with the running direction determination steps. Further, the CPU 11 drives the motor 2 through the input/output interface unit 15 in conformity with the processed result and runs the cage 5 in the set direction so as to respond to the registered floor call signal or hall call signal.

FIG. 5 is a program flow chart showing the running direction determination steps in the prior-art method of operating the elevator. The numerals in the figure designate deciding or processing steps, respectively. The flow chart will be described herebelow.

In the presence of any call signal, while the cage 5 is standing by at a certain floor without having a direction, the running direction of this cage is set at the direction of the call signal (steps 20–21–27). In the presence of a floor call or hall call signal in front of the cage 5 when this cage has a running direction, this running direction is held as it is (steps 20–21–31–26). Accordingly, calls before the frontward destination of the cage are ignored, while frontward calls are responded to with preference over a rearward floor call or hall call (frontward call preferring method) till the response of the cage 5 to the highest or lowest floor of the frontward call signals is carried out. Thereafter, in the presence of a floor call or hall call signal in rear of the position of the cage 5, this cage has the running direction reversed (steps 20–21–31–25–29) so as to respond to the previously ignored rearward call signal. In the absence of any call signal, the cage 5 is set to be nondirectional (steps 20–30) and is caused to stand by at the floor at which it is at a stop.

By the way, the step 25 is the step of deciding whether or not the running direction may be reversed. In order to hold the running direction without the reversal thereof even when a frontward call signal is registered with some delay, the answer "YES" of the decision is not generated before the lapse of a predetermined time interval with respect to the stop time of the cage 5 at the hall. Besides, the answer "YES" is generated when the cage 5 has come to the highest floor or lowest floor.

In the prior-art method of operating the elevator, the steps for determining the running direction of the cage 5 are constructed as stated above. Therefore, they have the advantage that the cage 5 responds in a predictable sequence though a difference of wait times is involved, as follows: By way of example, in a case where the user depresses the hall button 8 or 9 and calls the cage 5 at the hall of the intermediate floor 3F or 2F in order to go downstairs, the cage 5 assumed to already have the up direction ascends to the highest floor of the call signals and responds at this floor, and it reverses the running direction and comes back.

Meanwhile, the home elevator which is installed in a private house or the like has a capacity of 3 or so and is sometimes put into dedicated service, for example, a case where the cage 5 is exclusively used for carrying baggages downstairs by the user who has got on the cage 5 at the intermediate floor 2F or 3F. Besides, any urgent business matter might occur. Even on such an occasion, if the cage 5 has the up running direction and there is any call signal in front of the cage 5, this cage runs upwards with the running direction held as it is. Therefore, the prior-art method has the problem that the user cannot immediately go downstairs on the occasion.

SUMMARY OF THE INVENTION

This invention has been made in order to solve the problem as mentioned above, and has for its object to provide an elevator operating method comprising running direction determination steps in which the running direction of a cage is selected and set with preference over the direction of any other call, to the direction of a floor call based on a floor call button depressed by a user having got on the cage.

In order to accomplish the object, the steps for determining the running direction of a cage according to this invention consist in that, when a rearward floor call signal is registered anew during the stop of the cage at a hall, the running direction of the cage is reversed with the preference of the new registered signal over any other call signal.

With the cage running direction determination steps constructed as specified above, the running direction of the cage can be selected and set with preference over any other call signal, to the direction of a floor call based on a floor call button depressed anew by a user who has got on the cage.

BRIEF DESCRIPTION OF THE DRAWINGS

Throughout the drawings, the same symbols indicate identical or equivalent portions.

DESCRIPTION OF THE PREFERRED EMBODIMENTS

An embodiment of this invention will be described with reference to FIGS. 1-4.

Figure 1:
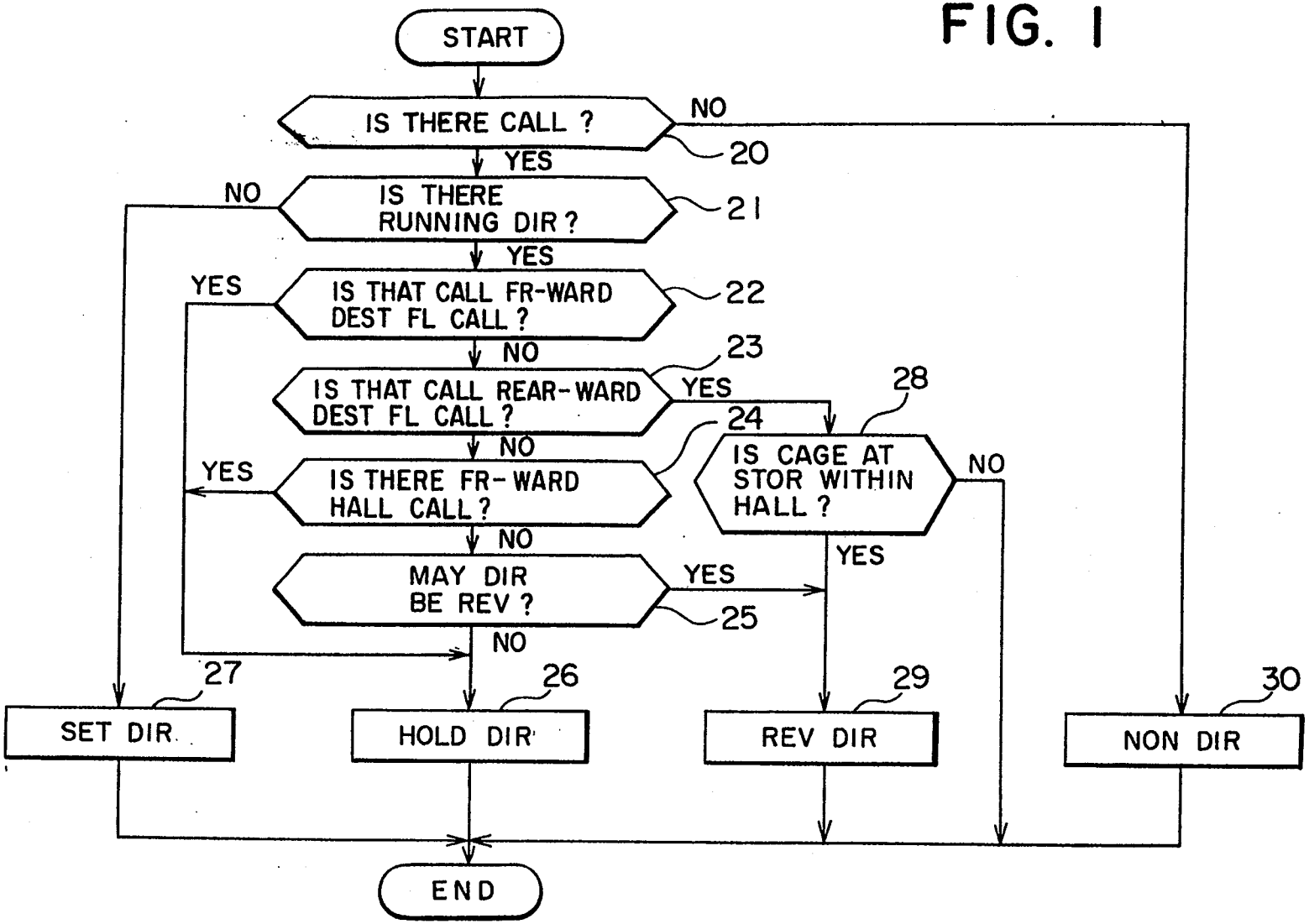
FIG. 1 is a program flow chart showing cage running direction determination steps which form an embodiment of this invention.

FIG. 1 is a program flow chart showing running direction determination steps in an elevator operating method which is one embodiment of this invention. The main flows in the figure will be described.

In the presence of a new floor call or hall call while the cage 5 is standing by at a hall without having a direction, the running direction is set in the direction of the call (steps 20-21-27). In the presence of a new floor call in front of the cage 5 when this cage has a running direction, the running direction is held as it is (steps 20-21-22-26). In the presence of a new rearward floor call while the cage 5 is at a stop at a hall, the running direction is reversed with the preference of this call over any other call (steps 20-21-22-23-28-29). In the presence of a frontward hall call which is not responded to yet when the floor calls of users in the cage 5 have been responded to, that is, when no user is present in the cage, the running direction is held as it is (steps 20-21-2-2-23-24-26). In the presence of only a rearward hall call, the running direction is reversed (steps 20-21-2-2-23-24-25-29). In the absence of any call, the cage 5 has its running direction set to be nondirectional and is caused to stand by at the floor at which it is at a stop (steps 20-30).

Figure 2:
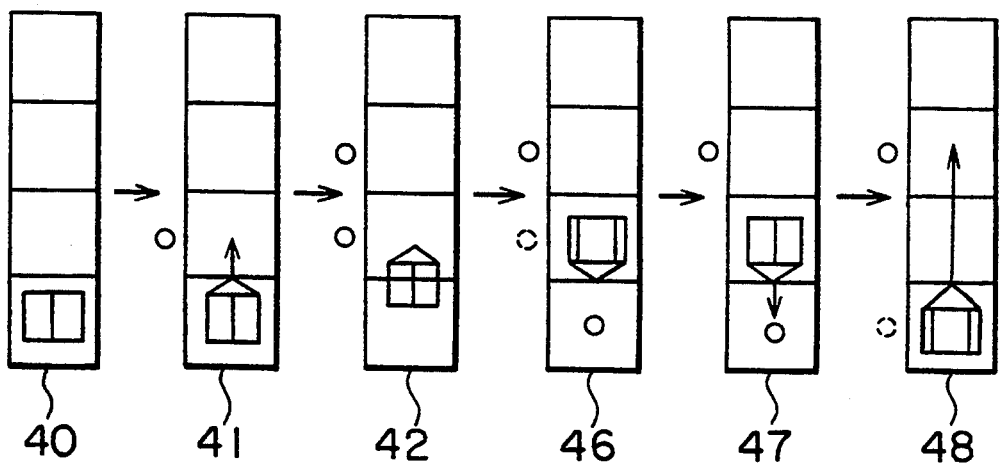
FIG. 2 is a diagram for explaining an example of the movements of a cage in an elevator in which the running direction determination steps in FIG. 1 are performed.
Figure 3:
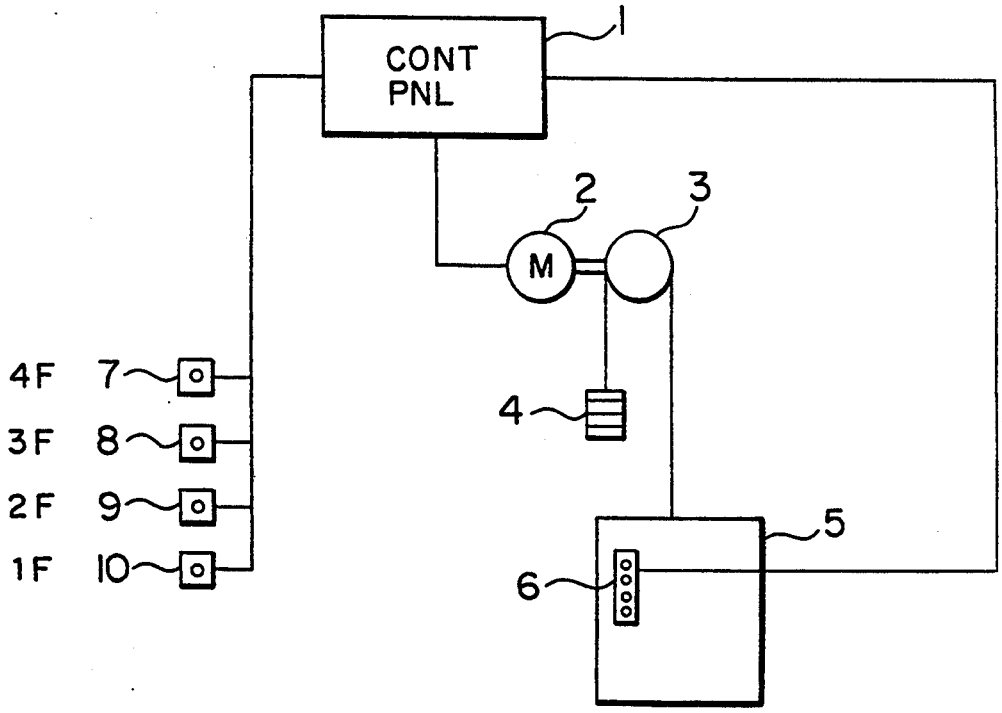
FIG. 3 PRIOR ART
FIG. 3 is a diagram of the conventional system of an elevator in which an operating method in the prior art and an operating method according to an embodiment of this invention are performed.
Figure 4:
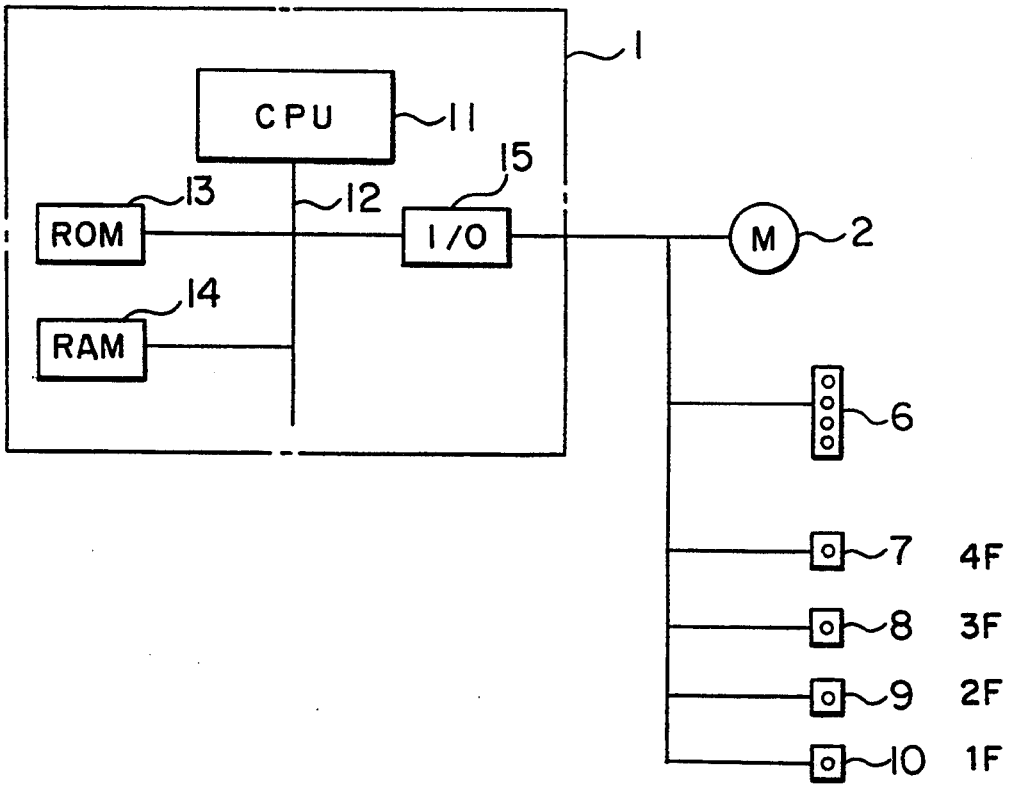
FIG. 4 PRIOR ART
FIG. 4 is a diagram of the internal arrangement of a control panel in FIG. 3.
Figure 5:
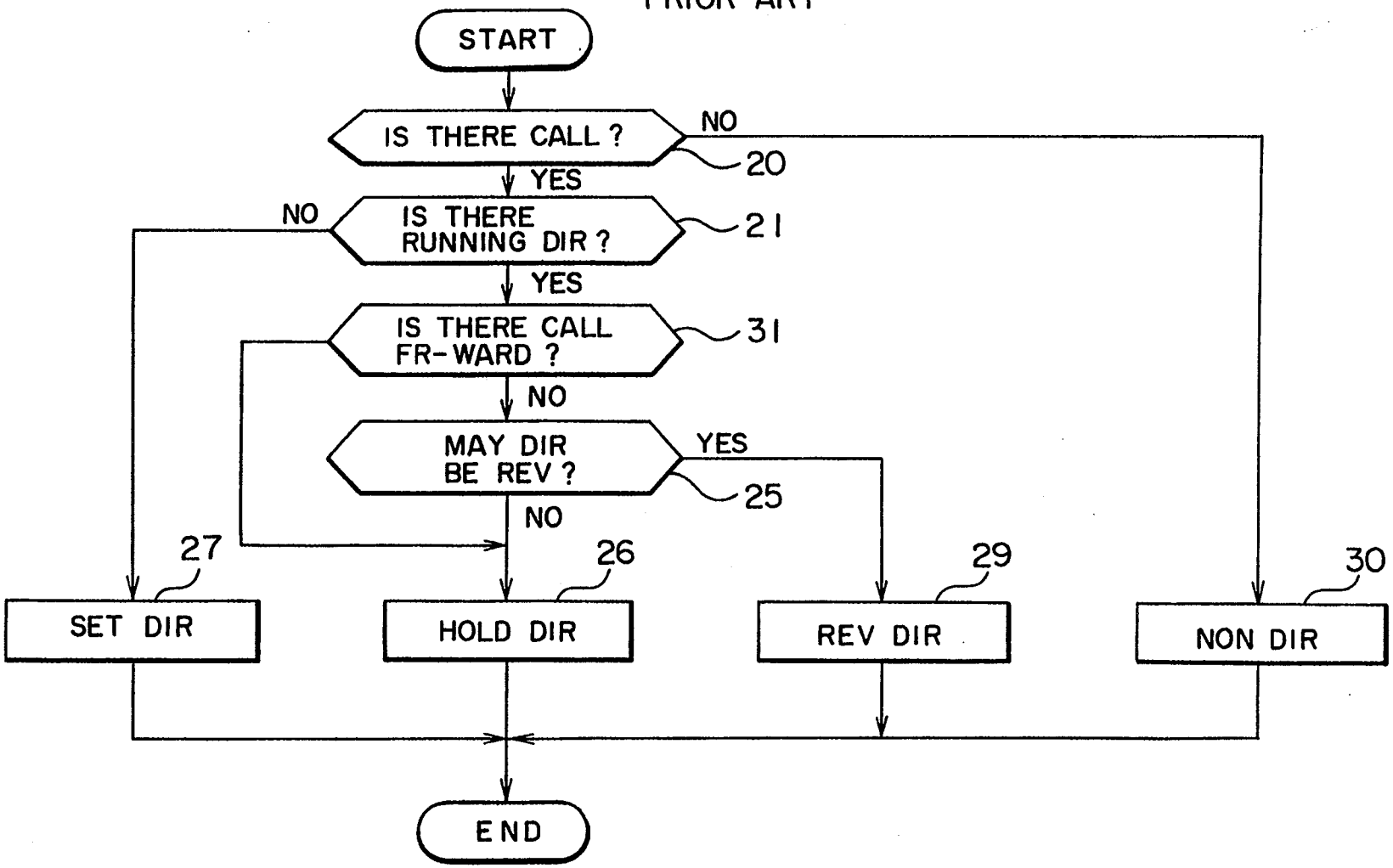
FIG. 5 PRIOR ART
FIG. 5 is a program flow chart showing cage running direction determination steps in the prior art.

FIG. 2 is a diagram for explaining an example of the movements of the cage of an elevator in which the running direction determination steps in FIG. 5 are performed, and which is installed in a 4-storeyed building. It is assumed by way of example that the floor call buttons and the hall buttons are depressed in a time sequence indicated below, and reference will be also had to FIG. 1.

While the cage 5 is standing by at the hall of the first floor without any direction assigned thereto and with its door closed (state 40), a user at the hall of the second floor depresses the hall button 9 (in FIG. 3) in order to go downstairs. Then, the step 20 in FIG. 1 for deciding the presence of a floor call or a hall call generates a result "YES". Since the cage 5 is standing by with no direction, the step 21 in FIG. 1 for deciding the presence of a running direction generates a result "NO". The up direction is set at the step 27 in FIG. 1 for setting the running direction to a direction in which the call or hall call exists, and the cage 5 starts running upwards (state 41). When a user at the hall of the third floor depresses the hall button 8 in order to go downstairs during the upward running of the cage 5, the hall button signal of the third floor is registered as the hall call signal of the third floor (state 42). The cage 5 stops at the hall of the second floor in response to the hall call of the second floor, and the registration of this hall call of the second floor is canceled. Here, it is assumed that a user who has got on the cage 5 during the stand-by thereof with its door open depresses the floor button of the first floor in the cage operation panel 6, whereupon the floor call signal of the first floor is registered anew. Then, the steps 20 and 21 in FIG. 1 generate results "YES" the step 22 in FIG. 1 for deciding if the destination floor call signal registered anew is in front of the cage 5 generates a result "NO", and the steps 23 and 28 in FIG. 1 generate results "YES". Consequently, with the preference of the new registered destination floor call signal of the first floor over the frontward hall call of the third floor in the running direction on that occasion as has been registered earlier, the running direction of the cage 5 is reversed to the down direction at the step 29 in FIG. 1 (state 46), and the cage 5 closes its door and starts running downwards (state 47). The cage 5 stops at the hall of the first floor, cancels the registration of the destination floor call of the first floor, and opens its door. Then, the user gets off the cage 5. Subsequently, since the hall call of the third floor remains without being responded to, the steps 20 and 21 in FIG. 1 generate results "YES", the steps 22, 23 and 24 generate results "NO", and the step 25 generates a result "YES" because of the first floor (the lowest floor of the building). Accordingly, the running direction is reversed to the up direction at the step 29 (state 48), and the cage 5 starts running upwards after closing its door. In accordance with another aspect of the invention, while the cage 5 is standing by at the first floor without any direction and with its doors closed, the user at the hall of the third floor depresses the hall button to go downward. The step 20 in FIG. 1 for deciding the presence of a floor call or a hall call generates a result "YES". Since the cage 5 is standing by with no direction, the step 21 in FIG. for deciding the presence of a running direction generates a result "NO". The up direction is set at the step 27 in FIG. 1 for setting the running direction to a direction in which the floor call or hall call exists and the cage 5 begins to run upward.

A user at the hall of the second floor depresses the hall button 8 to go downward before the cage reaches the second floor. The cage 5 stops at the hall of the second floor in response to the hall call of the second floor and the registration of this hall call of the second floor is cancelled. The cage running direction is then set by a floor call made by the user who enters the cage at the second floor. For example, when the user depresses the floor button of the first floor, the cage running direction is reversed to the down direction before the cage responds to the hall call placed at the third floor. Alternatively, when the user depresses the floor button of the fourth floor, the cage running direction is maintained and the cage stops at the third floor to respond to the hall call placed at the third floor before responding to the floor call of the fourth floor.

In the preceding example, the third floor is the original destination floor and the second floor is an intermediate floor between the original position of the cage and the original destination floor. Thus, it is seen that the elevator cage will stop at intermediate locations between the present position of the cage and a destination floor disposed ahead of the cage in the cage running direction to respond to hall calls placed subsequent to the original destination floor hall call.

Since this invention is constructed as described above, it brings forth an effect to be stated below.

According to the cage running direction determination steps of the elevator operating method of this invention, when a rearward floor call signal is registered anew during the stop of a cage at a hall, the running direction of the cage is reversed with the preference of the new registered signal over any other call signal. Therefore, the user of the cage can select and set the running direction of the cage to the direction of his/her destination floor with preference over any other call signal. This achieves the effect that the degree of exclusive use is enhanced, and that the above user can immediately go in the direction of his/her destination floor in such a case where the cage does not have any more room for other users or where an emergency situation has occurred.

Incidentally, with the steps of this invention, a response to the hall call might be delayed. However, considering the low frequency of use of an elevator for a private house and the small number of stopping places of the elevator, it can be said that the delay poses no problem in practical use.

What is claimed is:

1. A method of operating an elevator comprising the steps of:

(a) setting the cage running direction in accordance with a floor call placed after all other floor calls;

(b) stopping the cage to respond to hall calls placed at intermediate locations between the present position of the cage and a destination floor disposed ahead of the cage in the present running direction;

(c) reversing the cage running direction and giving preference to a floor call when the floor call is placed while the cage is at rest and the floor call is in a direction opposite to the set cage running direction;

(d) reversing the cage running direction regardless of the presence of a previously registered floor call or hall call when a floor call is placed in a direction opposite to the set cage running direction;

thereby providing passenger control of the elevator cage.

2. A method of operating an elevator cage in accordance with specified floor and hall calls comprising the steps of:

(a) setting the cage running direction in a direction of a destination in accordance with a floor call placed after all other floor calls;

(b) maintaining the cage running direction when a new floor call is placed calling for the same cage running direction;

(c) stopping the cage to respond to hall calls placed at intermediate locations between the present position of the cage and a destination floor disposed ahead of the cage in the present running direction;

(d) maintaining the cage running direction when a hall call is placed calling for the same cage running direction and all floor calls have been extinguished;

(e) reversing the cage running direction when a new floor call is placed while the cage is at rest regardless of the presence of a previously registered floor call or hall call when a floor call is registered in a direction opposite to the set cage running direction; and (f) setting the cage running direction to nondirectional and holding the cage in a rest position when all hall calls and floor calls have been extinguished;

whereby the running direction of the cage is passenger controlled.

* * * * *